US011674233B2

(12) United States Patent
Yamanaka et al.

(10) Patent No.: US 11,674,233 B2
(45) Date of Patent: Jun. 13, 2023

(54) SN-BASED PLATED STEEL SHEET

(71) Applicant: NIPPON STEEL CORPORATION, Tokyo (JP)

(72) Inventors: Shintaro Yamanaka, Tokyo (JP); Hirokazu Yokoya, Tokyo (JP); Yasuhiko Sato, Tokyo (JP); Hiroaki Ando, Tokyo (JP); Nobuo Nakasone, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/795,405

(22) PCT Filed: Feb. 1, 2021

(86) PCT No.: PCT/JP2021/003585
§ 371 (c)(1),
(2) Date: Jul. 26, 2022

(87) PCT Pub. No.: WO2021/192614
PCT Pub. Date: Sep. 30, 2021

(65) Prior Publication Data

US 2023/0102675 A1 Mar. 30, 2023

(30) Foreign Application Priority Data

Mar. 26, 2020 (JP) ..... JP2020-056475

(51) Int. Cl.
*C25D 3/30* (2006.01)
*C25D 5/10* (2006.01)
*C25D 3/54* (2006.01)

(52) U.S. Cl.
CPC ..... *C25D 3/30* (2013.01); *C25D 3/54* (2013.01); *C25D 5/10* (2013.01)

(58) Field of Classification Search
None
See application file for complete search history.

(56) References Cited

U.S. PATENT DOCUMENTS 4,999,258 A 3/1991 Wake et al.
2006/0141230 A1 6/2006 Miyoshi et al.
2011/0300402 A1* 12/2011 Tachiki ..... C23C 28/3455 428/340
2019/0292673 A1 9/2019 Yamanaka et al.
2019/0301043 A1* 10/2019 Yamanaka ..... C25D 3/30

FOREIGN PATENT DOCUMENTS

| | | | | |
|---|---|---|---|---|
| CN | 1836016 | A | 9/2006 | |
| JP | 63-290292 | A | 11/1988 | |
| JP | 2004-60052 | A | 2/2004 | |
| JP | 2007-284789 | A | 11/2007 | |
| JP | 2009-249691 | A | 10/2009 | |
| JP | 2010-13728 | A | 1/2010 | |
| JP | 2011-174172 | A | 9/2011 | |
| TW | 201812111 | A | 4/2018 | |
| WO | WO 2015/001598 | A1 | 1/2015 | |
| WO | WO-2017204265 | A1 * | 11/2017 | ..... B32B 15/012 |
| WO | WO-2018190412 | A1 * | 10/2018 | ..... B32B 15/013 |

OTHER PUBLICATIONS

Machine translation of Hirano et al. WO 2018/190412 A1 (Year: 2018).*
Machine translation of Hirano et al. WO 2017/204265 A1 (Year: 2017).*

* cited by examiner

*Primary Examiner* — Wojciech Haske
(74) *Attorney, Agent, or Firm* — Birch, Stewart, Kolasch & Birch, LLP

(57) ABSTRACT

To provide a Sn-based plated steel sheet capable of exhibiting superior corrosion resistance, yellowing resistance, coating film adhesiveness, and sulphide stain resistance without using a chromate film. A Sn-based plated steel sheet of the present invention includes: a steel sheet; a Sn-based plating layer located on at least one surface of the steel sheet; and a coating layer located on the Sn-based plating layer, wherein the Sn-based plating layer contains 1.0 g/m$^2$ to 15.0 g/m$^2$ of Sn per side in terms of metal Sn, the coating layer contains zirconium oxide, and a content of the zirconium oxide is 1.0 mg/m$^2$ to 10.0 mg/m$^2$ per side in terms of metal Zr, the zirconium oxide includes zirconium oxide with an amorphous structure, and a crystalline layer whose main component is zirconium oxide with a crystalline structure is present on an upper layer of the zirconium oxide with the amorphous structure.

3 Claims, No Drawings

SN-BASED PLATED STEEL SHEET

TECHNICAL FIELD

The present invention relates to a Sn-based plated steel sheet.

BACKGROUND ART

A tin (Sn) plated steel sheet is well known as "tinplate" and widely used for purposes of cans such as a beverage can, a food can, and other purposes. This is because Sn is safe for the human body and beautiful metal. The Sn-based plated steel sheet is mainly manufactured by an electroplating method. This is because the electroplating method is more advantageous than a hot-dip plating method to control the use amount of Sn, which is relatively expensive metal, to a minimum amount. After plating or after being given beautiful metallic luster by a heating and melting treatment after plating, the Sn-based plated steel sheet is often subjected to chromate coating on a Sn-based plating layer by a chromate treatment (electrolytic treatment, immersion treatment, and the like) using a solution of hexavalent chromate. Examples of an effect of the chromate coating include prevention of yellowing of an external appearance owing to suppression of oxidation of a surface of the Sn-based plating layer, prevention of deterioration in coating film adhesiveness due to cohesive failure of tin oxide when painted for use, improvement in sulphide stain resistance.

On the other hand, recently, it is required that a final product does not contain hexavalent chromium and the chromate treatment itself is not performed because of an increase in awareness of the environment and safety. However, a Sn-based plated steel sheet without the chromate coating yellows in the external appearance due to growth of the tin oxide as mentioned above. Therefore, there are some proposed Sn-based plated steel sheets subjected to a coating treatment in place of the chromate coating.

For example, the following Patent Document 1 proposes a Sn-based plated steel sheet in which a coating containing P and Si is formed by a treatment using a solution containing phosphate ions and a silane coupling agent.

The following Patent Document 2 proposes a Sn-based plated steel sheet in which a coating containing: Al and P; at least one kind selected from Ni, Co, and Cu; and a reaction product with a silane coupling agent is formed by treatment with a solution containing aluminum phosphate.

The following Patent Document 3 proposes a method of manufacturing a Sn-based plated steel sheet without a chromate coating of plating Zn on a Sn-based plating and then heating the steel sheet until a Zn independent plating layer vanishes.

The following Patent Documents 4 and 5 propose a steel sheet for containers with a chemical conversion coating containing zirconium, phosphoric acid, phenolic resin, and the like.

The following Patent Document 6 proposes a Sn-based plated steel sheet with a Sn-based plating layer and a conversion treatment layer containing tin oxide and tin phosphate, which is formed by a cathode electrolytic treatment followed by an anode electrolytic treatment in an aqueous phosphate solution after the formation of the Sn-based plating layer. Patent Document 6 also proposes that alternating electrolysis, in which a cathode electrolytic treatment and an anode electrolytic treatment are alternated, may be performed when forming the coating.

The following Patent Document 7 proposes a Sn-based plated steel sheet with a coating film containing tin oxide and Zr, Ti, and P.

PRIOR ART DOCUMENT

Patent Document

Patent Document 1: Japanese Laid-open Patent Publication No. 2004-060052

Patent Document 2: Japanese Laid-open Patent Publication No. 2011-174172

Patent Document 3: Japanese Laid-open Patent Publication No. S63-290292

Patent Document 4: Japanese Laid-open Patent Publication No. 2007-284789

Patent Document 5: Japanese Laid-open Patent Publication No. 2010-013728

Patent Document 6: Japanese Laid-open Patent Publication No. 2009-249691

Patent Document 7: International Publication Pamphlet No. WO 2015/001598

DISCLOSURE OF THE INVENTION

Problems to be Solved by the Invention

The methods proposed in the above Patent Documents 1 to 7 have a problem that corrosion resistance is slightly inferior to that of chromate coating tinplate, and there has been room for improvement in the corrosion resistance. Therefore, there has been a need for a Sn-based plated steel sheet with superior corrosion resistance as well as yellowing resistance, coating film adhesiveness, and sulphide stain resistance.

The present invention has been made in consideration of the above problems, and an object thereof is to provide a Sn-based plated steel sheet excellent in corrosion resistance, yellowing resistance, coating film adhesiveness, and sulphide stain resistance without the use of a chromate coating.

Means for Solving the Problems

To solve the above problem, the inventors have studied diligently and found that it is possible to achieve a Sn-based plated steel sheet with better corrosion resistance than before by forming a coating layer containing zirconium oxide on a surface of a Sn-based plated steel sheet and by setting the distribution of a crystal structure of the zirconium oxide in the coating layer to a specific state.

The summary of the present invention completed based on the above findings is as follows.

(1) A Sn-based plated steel sheet includes: a steel sheet; a Sn-based plating layer located on at least one surface of the steel sheet; and a coating layer located on the Sn-based plating layer, wherein: the Sn-based plating layer contains 1.0 $g/m^2$ to 15.0 $g/m^2$ of Sn per side in terms of metal Sn; the coating layer contains zirconium oxide and a content of the zirconium oxide is 1.0 $mg/m^2$ to 10.0 $mg/m^2$ per side in terms of metal Zr; the zirconium oxide includes zirconium oxide with an amorphous structure, and a crystalline layer whose main component is zirconium oxide with a crystalline structure is present on an upper layer of the zirconium oxide with the amorphous structure.

Here, in an electron beam diffraction pattern, the crystalline structure is determined when a clear diffraction spot is obtained, and the amorphous structure is determined when a continuous ring-shaped diffraction pattern is obtained instead of the clear diffraction spot.

(2) The Sn-based plated steel sheet according to (1), wherein the crystalline layer in the coating layer includes an uppermost surface portion of the coating layer, and the number of detected locations of the crystalline layer is at least one or more in order from the uppermost surface portion in a thickness direction.

Here, the uppermost surface portion means a portion including an uppermost surface of the coating layer among each of 10 equal portions of the coating layer in the thickness direction at any position of the coating layer, and the number of detected locations of the crystalline layer means the number of locations determined to be the crystalline structure among 10 measured locations in the electron beam diffraction pattern at a center portion of the thickness direction of each portion among 10 equal portions where the coating layer is divided into 10 equal portions in the thickness direction at any position of the coating layer.

(3) The Sn-based plated steel sheet according to (2), wherein the number of detected locations of the crystalline layer is five or less, including the uppermost surface portion of the coating layer and in order from the uppermost surface portion in the thickness direction.

Effect of the Invention

As explained above, according to the present invention, it is possible to provide a Sn-based plated steel sheet excellent in corrosion resistance, yellowing resistance, coating film adhesiveness, and sulphide stain resistance without performing the conventional chromate treatment.

EMBODIMENTS FOR CARRYING OUT THE INVENTION

Hereinafter, preferable embodiments of the present invention will be explained in detail.

Note that the term "step" in this specification includes not only an independent step but also a step even if it cannot be discriminated from other steps but if its desired object can be achieved. The term "steel sheet" in this specification means a base material steel sheet (so-called plating substrate) being an object on which a Sn-based plating layer and a coating layer are to be formed.

Further, the present invention explained below relates to a Sn-based plated steel sheet widely used for purposes of cans such as a food can and a beverage can and other purposes and a manufacturing method of the Sn-based plated steel sheet. More concretely, the present invention relates to a Sn-based plated steel sheet more excellent in corrosion resistance (in more detail, post-coating corrosion resistance), yellowing resistance, coating film adhesiveness, and sulphide stain resistance without performing the conventional chromate treatment and a manufacturing method of the Sn-based plated steel sheet.

Concretely, a Sn-based plated steel sheet according to this embodiment includes: a steel sheet; a Sn-based plating layer located on at least one surface of the steel sheet; and a coating layer located on the Sn-based plating layer. Here, the Sn-based plating layer contains 1.0 g/m$^2$ to 15.0 g/m$^2$ of Sn per side in terms of metal Sn. The coating layer contains zirconium oxide, and a content of the zirconium oxide is 1.0 mg/m$^2$ to 10.0 mg/m$^2$ per side in terms of metal Zr. The zirconium oxide includes zirconium oxide with an amorphous structure, and a crystalline layer whose main component is zirconium oxide with a crystalline structure is present on an upper layer of the zirconium oxide with the amorphous structure.

Hereinafter, a Sn-based plated steel sheet and a manufacturing method thereof according to this embodiment will be described in detail.

<Steel Sheet>

Steel sheets are not limited, and any steel sheet commonly used for Sn-based plated steel sheets for containers can be used. Such steel sheets include, for example, low carbon steel and ultra-low carbon steel. A manufacturing method and material of steel sheets are also not limited. For example, steel sheets manufactured through processes such as casting, hot rolling, pickling, cold rolling, annealing, and temper rolling can be used.

<Sn-Based Plating Layer>

A Sn-based plating layer is formed on at least one surface of the steel sheet as described above, and corrosion resistance of the steel sheet is improved by the Sn-based plating layer. The term "Sn-based plating layer" as used herein refers not only to a Sn-based plating layer with metal Sn alone, but also to a Sn-based plating layer containing alloys of metal Sn and metal Fe, metal Ni, and at least one of a trace element other than metal Sn or impurities (for example, Fe and Ni, Ca, Mg, Zn, Pb, Co, and the like).

The Sn-based plating layer contains 1.0 g/m$^2$ to 15.0 g/m$^2$ of Sn per side in terms of metal Sn. In other words, a coating weight of the Sn-based plating layer per side is 1.0 g/m$^2$ to 15.0 g/m$^2$ by metal Sn amount (that is, in terms of metal Sn). When the coating weight of the Sn-based plating layer per side by metal Sn amount is less than 1.0 g/m$^2$, the corrosion resistance is poor, which is undesirable. The corrosion resistance is excellent when the coating weight of the Sn-based plating layer per side by metal Sn amount is 1.0 g/m$^2$ or more. The coating weight of the Sn-based plating layer per side by metal Sn amount is preferably 2.0 g/m$^2$ or more, and more preferably 5.0 g/m$^2$ or more. On the other hand, when the coating weight of the Sn-based plating layer per side by metal Sn amount exceeds 15.0 g/m$^2$, an effect of metal Sn in improving corrosion resistance is sufficient, and a further increase in the coating weight is not desirable from an economic standpoint. When the coating weight of the Sn-based plating layer per side by metal Sn amount exceeds 15.0 g/m$^2$, coating film adhesiveness also tends to decrease. The coating weight of the Sn-based plating layer per side by metal Sn amount is 15.0 g/m$^2$ or less, and it becomes possible to achieve both excellent corrosion resistance and coating film adhesiveness while suppressing cost increase. The coating weight of the Sn-based plating layer per side by metal Sn amount is preferably 13.0 g/m$^2$ or less, and more preferably 10.0 g/m$^2$ or less to achieve both excellent corrosion resistance and coating film adhesiveness at low cost.

Here, the metal Sn amount in the Sn-based plating layer (that is, the coating weight of the Sn-based plating layer per side) is, for example, a value measured by an electrolytic method described in JIS G 3303 or an X-ray fluorescence method.

Alternatively, the metal Sn amount in the Sn-based plating layer can also be found, for example, by the following method. A test piece without a coating layer is prepared. The test piece is immersed in 10% nitric acid to dissolve the Sn-based plating layer, and Sn in the obtained solution is found by ICP (inductively coupled plasma) emission spectrometry (using, for example, 799ce manufactured by Agilent Technologies Japan, Ltd, and Ar as carrier gas). Then, the metal Sn amount can be found based on an intensity signal obtained by the analysis, a calibration curve created from a solution having a known concentration, and an area where the Sn-based plating layer is formed on the test piece.

Alternatively, in the case of a test piece with a coating layer formed thereon, the metal Sn amount can be found by a calibration curve method using GDS (glow discharge spectroscopy), and the method is, for example, as follows. A plating sample having a known metal Sn amount (authentic sample) is used to find a relation between the intensity signal of the metal Sn in the authentic sample and a sputter rate by GDS and create a calibration curve in advance. Based on the calibration curve, the amount of metal Sn can be found from an intensity signal of a test piece having an unknown metal Sn amount and the sputter rate. Here, the Sn-based plating layer is defined as a portion from a depth where an intensity signal of Zr becomes ½ of a maximum value of the intensity signal of Zr to a depth where an intensity signal of Fe becomes ½ of a maximum value of the intensity signal of Fe.

From the viewpoint of measurement precision and swiftness, the measurement by the X-ray fluorescence method is preferable in terms of industry.

A method of applying the Sn-based plating to a surface of the steel sheet is not limited, but a publicly-known electroplating method is preferable. As the electroplating method, for example, an electrolytic method using well-known acidic baths such as sulfuric acid bath, fluoroborate bath, phenolsulfonic acid bath, and methanesulfonic acid bath or alkaline bath can be used. Note that a melting method of applying Sn-based plating by immersing the steel sheet in molten Sn may be used.

Further, after the Sn-based plating, a heating and melting treatment of heating the steel sheet having the Sn-based plating layer to 231.9° C. or higher, which is the melting point of Sn, may be performed. Through the heating and melting treatment, a surface of the Sn-based plating layer takes a polish and an alloy layer of Sn and Fe is formed between the Sn-based plating layer and the steel sheet to further improve the corrosion resistance.

<Coating Layer Containing Zirconium Oxide>

The Sn-based plated steel sheet of this embodiment has a coating layer containing zirconium oxide on the surface of the Sn-based plating layer formed on a surface of the steel sheet. The zirconium oxide must include zirconium oxide with an amorphous structure and zirconium oxide with a crystalline structure.

The fact that the coating layer contains zirconium oxide with the amorphous structure reduces the number of crystal grain boundaries that serve as permeation paths for corrosion factors such as oxygen and chloride ions compared to a coating layer containing only zirconium oxide with the crystalline structure. As a result, corrosion factors are less likely to reach the Sn surface and the corrosion resistance of the coating layer is improved.

Here, the structure of zirconium oxide is determined by an electron beam diffraction pattern using a transmission electron microscope. That is, the crystalline structure is defined when a clear diffraction spot is obtained in the electron beam diffraction pattern, and the amorphous structure is defined when no diffraction spot is obtained and a continuous ring-shaped diffraction pattern is obtained. Concretely, any portion of the Sn-based plated steel sheet is subjected to FIB (focused ion beam) to prepare a sample for TEM (transmission electron microscope) observation and a crystal structure can be determined as stated above by examining the diffraction pattern obtained by electron beam diffraction at any coating position with a beam diameter of 1 nm.

The zirconium oxide with the amorphous structure in this embodiment is preferably contained in the coating layer with an amorphous structure ratio of 50% or more. The definition of the "amorphous structure ratio" in this embodiment is described below for convenience of explanation. The amorphous structure ratio in the coating layer of 50% or more makes it possible to further improve the corrosion resistance of the coating layer. The amorphous structure ratio in the coating layer is more preferably 60% or more. An upper limit of the amorphous structure ratio is 90%.

The amorphous structure ratio defined here is a value calculated from a percentage of locations where the amorphous structure was obtained in the coating layer. Concretely, electron beam diffraction patterns are measured at any 10 locations in a thickness direction at any position on a surface of the coating layer. When the continuous ring-shaped diffraction pattern, rather than the clear diffraction spot, is obtained in these measurement results, the structure is determined to be the amorphous structure. The amorphous structure ratio is defined as the percentage of the amorphous structure obtained among a total of 10 locations measured in this way.

Amorphous structure ratio (%)=(Number of locations where amorphous structure was obtained/10)×100

It is preferable to measure the number of detected locations of the amorphous structure as described above at any three positions of the coating layer, and it is more preferable to measure at any five positions of the coating layer. A maximum number of detected locations at each measurement position is defined as the number of detected locations of the amorphous structure.

The coating layer of this embodiment has a crystalline layer whose main component is zirconium oxide with the crystalline structure on an upper layer of the zirconium oxide with the amorphous structure as described above. This is because when a Sn-based plated steel sheet is painted for use, the presence of the zirconium oxide with the crystalline structure on a surface layer side of the Sn-based plated steel sheet is better for the coating film adhesiveness. The crystal structure of zirconium oxide includes a monoclinic system, but other crystal structures such as a tetragonal crystal and a cubic crystal may be included. The above "main component is zirconium oxide with the crystalline structure" means that a content of the zirconium oxide with the crystalline structure is 50 mass % or more in the crystalline layer.

A mechanism of better coating film adhesiveness with the zirconium oxide with the crystalline structure than with the zirconium oxide with the amorphous structure on the surface layer side may be that a contact interface with a coating film is increased due to microscopic irregularities of a crystal plane, and that reactivity of the crystalline structure with the coating film is higher because the crystalline structure is more reactive than the amorphous structure.

The crystalline layer in the coating layer preferably includes an uppermost surface portion of the coating layer, and the number of detected locations of the crystalline layer is at least one or more in order from the uppermost surface portion in a thickness direction. Here, the above-mentioned uppermost surface portion means a portion including an uppermost surface of the coating layer among each of 10 equal portions of the coating layer in the thickness direction at any position of the coating layer. In other words, it means that the zirconium oxide with the crystalline structure is present on the uppermost surface of the Sn-based plated steel sheet. The number of detected locations of the crystalline layer means the number of locations determined to be the crystalline structure among 10 measured locations in the electron beam diffraction pattern at a center portion of the thickness direction of each portion among 10 equal portions where the coating layer is divided into 10 equal portions in the thickness direction at any position of the coating layer. The presence of the crystalline layer at the above position makes it possible to achieve even better coating film adhesiveness.

The number of detected locations of the crystalline layer is preferably five or less, including the uppermost surface portion of the coating layer and in order from the uppermost surface portion in the thickness direction. By setting the number of detected locations to five or less, it is possible to achieve both the corrosion resistance and the coating film adhesiveness more reliably.

The number of detected locations of the crystalline layer as described above is preferably measured at any three positions of the coating layer, and more preferably at any five positions of the coating layer.

The zirconium oxide content in the coating layer is 1.0 $mg/m^2$ to 10.0 $mg/m^2$ per side in terms of metal Zr. When the zirconium oxide content in the coating layer is 1.0 $mg/m^2$ or more per side in terms of metal Zr, a barrier property provided by the zirconium oxide is sufficient, and sulphide stain resistance for food products or the like containing amino acids becomes good. The zirconium oxide content in the coating layer per side is preferably 6.0 $mg/m^2$ or more in terms of metal Zr. On the other hand, when the zirconium oxide content in the coating layer exceeds 10.0 $mg/m^2$ per side in terms of metal Zr, the coating film adhesiveness tends to decrease due to cohesive failure of the zirconium oxide itself. When the zirconium oxide content in the coating layer is 10.0 $mg/m^2$ or less per side in terms of metal Zr, it is possible to maintain the excellent coating film adhesiveness. The zirconium oxide content in the coating layer per side is preferably 8.0 $mg/m^2$ or less in terms of metal Zr.

Here, the zirconium oxide content in the coating layer is the content of zirconium oxide per side. In addition to the zirconium oxide, the coating layer may also contain other elements such as Fe, Ni, Cr, Ca, Na, Mg, Al, and Si. The coating layer may also contain one or two or more types of tin fluoride and tin oxide, tin phosphate, zirconium phosphate, calcium hydroxide, and calcium, or a composite compound of these elements. The zirconium oxide content (metal Zr amount) in the coating layer is a value, which is obtained by immersing the Sn-based plated steel sheet in an acidic solution such as hydrofluoric acid and sulfuric acid, for example, to dissolve and the resulting dissolved solution is measured by chemical analysis such as the ICP emission spectrometry. The zirconium oxide content (metal Zr amount) may be determined by X-ray fluorescence measurement.

<Forming Method of Coating Film>

Hereinafter, a forming method of the coating layer containing zirconium oxide is described.

The coating layer containing zirconium oxide can be formed on a surface of the Sn-based plating layer by immersing the Sn-based plated steel sheet in an aqueous solution containing zirconium ions and performing a cathode electrolytic treatment with the Sn-based plated steel sheet as a cathode. The coating layer containing zirconium oxide can be formed on the Sn-based plated steel sheet owing to forcible movement of charges by the cathode electrolytic treatment and surface cleaning by generation of hydrogen at an interface of the steel sheet in conjunction with an adhesion-promoting effect by pH increase.

Here, it is necessary to increase a precipitation rate of zirconium oxide on the Sn-plated surface and to increase a nucleation rate rather than crystal growth to form the zirconium oxide with the amorphous structure in the coating. For this purpose, after forming the Sn-based plating on the surface of the steel sheet or after forming the Sn-based plating layer, the steel sheet is subjected to the heating and melting treatment of heating to 231.9° C. or higher, which is the melting point of Sn, then immersed in cooling water with hardness WH (calcium concentration (ppm)×2.5+magnesium concentration (ppm)×4.1) of in a range of 100 ppm or more and 300 ppm or less, and then the Sn-based plated steel sheet is immersed in an aqueous solution containing zirconium ions, and subjected to the cathode electrolytic treatment with the Sn-based plated steel sheet as the cathode at a specified current density range.

By setting the hardness of the cooling water within the above range, a compound containing either or both calcium and magnesium adheres to the Sn-based plated surface and acts as a nucleus during the subsequent zirconium coating precipitation, resulting in fine precipitation of zirconium oxide to form the zirconium oxide with the amorphous structure. Here, when the hardness WH of the cooling water exceeds 300 ppm, the compound containing either or both calcium and magnesium adheres and aggregates excessively on the Sn-based plated surface, resulting in non-uniform and localized formation and growth of zirconium oxide, and thus the zirconium oxide with the amorphous structure cannot be obtained. The hardness WH of the cooling water is preferably 250 ppm or less. When the hardness WH of the cooling water is 250 ppm or less, zirconium oxide is likely to be more uniformly generated. On the other hand, when the hardness WH of the cooling water is less than 100 ppm, there are few starting points for nucleation during zirconium oxide precipitation, and the zirconium oxide is formed at non-uniform points on the Sn-based plated surface, resulting in coarse zirconium oxide and no formation of the zirconium oxide with the amorphous structure. The hardness WH of the cooling water is preferably 150 ppm or more.

An immersion time in the cooling water is preferably 0.5 seconds to 5.0 seconds. When the immersion time in the cooling water is less than 0.5 seconds, adhesion of the compound containing either or both calcium and magnesium to the Sn-based plated surface becomes insufficient, and the zirconium oxide with the amorphous structure is difficult to obtain. On the other hand, when the immersion time in the cooling water exceeds 5.0 seconds, the compound containing either or both calcium and magnesium adheres and aggregates excessively on the Sn-based plated surface, resulting in generation and growth of the zirconium oxide non-uniformly and locally, making it difficult to obtain the zirconium oxide with the amorphous structure.

A temperature of the cooling water is preferably 10° C. to 80° C. When the temperature of the cooling water is less than 10° C., the adhesion of the compound containing either or both calcium and magnesium to the Sn-based plated surface will be insufficient, and the zirconium oxide with the amorphous structure is difficult to obtain. On the other hand, when the temperature of the cooling water exceeds 80° C., the compound containing either or both calcium and magnesium adheres and aggregates excessively on the Sn-based plated surface, resulting in generation and growth of the zirconium oxide non-uniformly and locally, making it difficult to obtain the zirconium oxide with the amorphous structure.

An interval between an end of the above cooling water immersion treatment and a start of the subsequent cathode electrolytic treatment is preferably within 10 seconds, and more preferably within five seconds.

A current density for the cathode electrolytic treatment is preferably set from 2.0 A/dm$^2$ to 10.0 A/dm$^2$. When the current density is less than 2.0 A/dm$^2$, a forming rate of zirconium oxide is slow and the zirconium oxide with the amorphous structure is difficult to obtain. This is thought to be because zirconium and oxygen atoms can diffuse sufficiently to form a stable crystal lattice in a process of forming the zirconium oxide due to a slow precipitation rate of the zirconium oxide resulting from low hydrogen generation from the surface of the Sn-based plated steel sheet when the current density is less than 2.0 A/dm$^2$. On the other hand, when the current density exceeds 10.0 A/dm$^2$, the hydrogen generation from the surface of the Sn-based plated steel sheet becomes active and the pH near the surface of the steel sheet becomes high to a bulk of the treatment solution, resulting in the generation of the zirconium oxide in the treatment solution. The generated zirconium oxide becomes larger by the time it adheres to the steel sheet surface, making it difficult to obtain the zirconium oxide with the amorphous structure, and a thickness of the zirconium coating becomes thicker and an external appearance is inferior.

To form the zirconium oxide with the crystalline structure on an upper layer of the zirconium oxide with the amorphous structure, the Sn-based plated steel sheet having the zirconium oxide with the amorphous structure is formed by cathode electrolysis in the electrolytic treatment solution containing zirconium ions, and then electrolytic treatment is performed at low current density. Concretely, after forming zirconium with the amorphous structure by the cathode electrolytic treatment at the current density of 2.0 A/dm$^2$ to 10.0 A/dm$^2$, the cathode electrolytic treatment at the current density of less than 1.0 A/dm$^2$ is performed.

A concentration of zirconium ions in the cathode electrolytic solution may be appropriately adjusted according to production facility and production rate (ability). For example, the zirconium ion concentration is preferably 1000 ppm or more and 4000 ppm or less. There is no problem if the solution containing zirconium ions contains other components such as fluorine ions, phosphate ions, ammonium ions, nitrate ions, sulfate ions, and chloride ions. A supply source of zirconium ions in the cathode electrolytic solution can be a zirconium complex such as $H_2ZrF_6$, for example. Zr in the Zr complex as described above is present in the cathode electrolytic solution as $Zr^{4+}$ due to an increase in the pH at a cathode electrode interface. Such Zr ions react further in the cathode electrolytic solution to form the zirconium oxide.

As a solvent of the cathode electrolytic solution when performing the cathode electrolytic treatment, for example, water such as distilled water can be used. However, the solvent is not limited to water such as distilled water but can be appropriately selected according to the material to be dissolved, the forming method, or the like.

A solution temperature of the cathode electrolytic solution for the cathode electrolytic treatment is preferably set to, for example, a range of 5° C. to 50° C. Performing the cathode electrolysis at 50° C. or lower enables the formation of a dense and uniform structure of the coating layer which is formed of extremely fine particles. On the other hand, when the solution temperature is less than 5° C., forming efficiency of the coating may be low. When the solution temperature exceeds 50° C., the formed coating is nonuniform, and defects, cracks, microcracks, or the like occur to make the formation of the dense coating difficult, resulting in causing a starting point of corrosion or the like, which is not preferable.

The pH of the cathode electrolytic solution is preferably set to 3.5 to 4.3. When the pH is less than 3.5, a precipitation efficiency of a Zr coating may deteriorate, whereas when the pH exceeds 4.3, the zirconium oxide tends to precipitate in the solution, resulting in the coarse and rough Zr coating.

For example, nitric acid, ammonia water, or the like may be added to the cathode electrolytic solution to adjust the pH and to increase the electrolysis efficiency of the cathode electrolytic solution.

When forming the coating layer, the time of the cathode electrolytic treatment is not limited. The time of the cathode electrolytic treatment only needs to be adjusted according to the current density with respect to the targeted zirconium oxide content (metal Zr amount) in the coating layer. An electricity pattern for the cathode electrolytic treatment may be continuous or intermittent.

The Sn-based plated steel sheet and its manufacturing method of this embodiment have been described above.

EXAMPLES

Next, the Sn-based plated steel sheet and the manufacturing method of the Sn-based plated steel sheet according to the present invention will be concretely explained while illustrating examples and comparative examples. Note that the following examples are merely examples of the Sn-based plated steel sheet and the manufacturing method of the Sn-based plated steel sheet according to the present invention, and the Sn-based plated steel sheet and the manufacturing method of the Sn-based plated steel sheet according to the present invention are not limited to the following examples.

<Method of Producing a Test Material>

A method of producing a test material will be explained. Note that later-explained test materials in examples were produced according to the method of producing the test material.

First, a low-carbon cold-rolled steel sheet with a sheet thickness of 0.2 mm was subjected to electrolytic alkali degreasing, water washing, dilute sulfuric acid immersion pickling, and water washing as pretreatments, then subjected to Sn-based electroplating using a phenolsulfonic acid bath, and then subjected to a heating and melting treatment. Through these treatments, the Sn-based plating layers were formed on both surfaces of the steel sheet that had undergone these treatments. The coating weight of the Sn-based plating layer per side by metal Sn amount was set to about 2.8 g/m$^2$ as a standard. The coating weight of the Sn-based plating layer was adjusted by changing an energization time. Some test materials were not subjected to the above heating and melting treatment.

Next, the steel sheet on which the Sn-based plating layers were formed was immersed in cooling water with a predetermined hardness for a predetermined time. Within five seconds thereafter the plated steel sheet that had undergone the immersion treatment was subjected to the cathode electrolytic treatment in an aqueous solution containing zirconium fluoride (cathode electrolytic solution) to form a coating layer containing zirconium oxide on a surface of each Sn-based plating layer. The temperature of the cathode electrolytic solution was set to 35° C. and the pH of the cathode electrolytic solution was adjusted to be 3.0 to 5.0. The current density of the cathode electrolytic treatment and the treatment time of the cathode electrolytic treatment were adjusted according to the targeted zirconium oxide content (metal Zr amount) in the coating layer. When the cathode electrolytic treatments were performed two times, the second cathode electrolytic treatment was performed immediately after the first cathode electrolytic treatment was completed and the current density setting was changed.

The Sn-based plated steel sheets prepared in this way were subjected to various evaluations as follows.

[Coating Weight of Sn-Based Plating Layer Per Side (Metal Sn Amount of Sn-Based Plating Layer)]

The coating weight of the Sn-based plating layer per side (metal Sn amount of the Sn-based plating layer) was measured as follows. Several test pieces of steel sheet having the Sn-based plating layers with known metal Sn content were prepared. Next, each test piece was analyzed using an X-ray fluorescence analysis apparatus (ZSX Primus, manufactured by Rigaku Corporation) to measure X-ray fluorescence intensity derived from metal Sn in advance from a surface of the Sn-based plating layer of the test piece. Then, a calibration curve representing a relationship between the measured X-ray fluorescence intensity and the metal Sn amount was prepared. Then, the coating layer was removed from the Sn-based plated steel sheet to be a measurement object to prepare a test piece exposing the Sn-based plating layer. The X-ray fluorescence intensity derived from metal Sn was measured on the surface where the Sn-based plating layer was exposed using the X-ray fluorescence apparatus. The coating weight of the Sn-based plating layer per side (that is, the metal Sn content) was calculated by using the obtained X-ray fluorescence intensity and the calibration curve prepared in advance.

Note that measurement conditions were as follows, X-ray source: Rh, tube voltage: 50 kV, tube current: 60 mA, dispersive crystal: LiF1, and measurement diameter: 30 mm.

[Investigation of Structure of Coating Layer]

Samples for TEM observation were produced to investigate the structure of the coating layer by using FIB (Quata 3D FEG, manufactured by FEI Corporation), each prepared sample was subjected to observation of any field of view at an acceleration voltage of 200 kV and 100,000 magnifications by using TEM (field-emission transmission electron microscope JEM-2100F, manufactured by JEOL Ltd.), and then an electron beam diffraction pattern of the coating layer was examined at a beam diameter of 1 nm. When a continuous ring-shaped diffraction pattern was obtained instead of a clear diffraction spot in the obtained electron beam diffraction pattern, it was determined to be the amorphous structure. An amorphous structure ratio was defined as a percentage of locations determined to be the amorphous structure among 30 locations measured, which are the sum of any 10 locations in a coating thickness direction at each of three positions on the surface of the coating layer.

Amorphous structure ratio (%)=(Number of locations where amorphous structure was obtained/30)×100

When the clear diffraction spot was obtained in the electron beam diffraction pattern, it was determined to be the crystalline structure. When the crystalline structure was found on a surface layer side of the coating layer at all of any three positions, it was determined that the crystalline layer formed of the zirconium oxide with the crystalline structure is present on an upper layer of the zirconium oxide with the amorphous structure.

At each of any three positions of the coating layer, the coating layer was divided into 10 equal portions in the thickness direction, and the number of locations determined to be the crystalline structure among measured 10 locations was checked in the electron diffraction pattern at a center portion of the thickness direction of each portion among 10 equal portions. A maximum value of the number of detected locations at the three positions was defined as the number of detected locations of the crystalline layer.

[Content of Zirconium Oxide (Metal Zr Amount) in Coating Layer]

The content of the zirconium oxide (metal Zr amount) in the coating layer was measured according to the measurement method of the coating weight of the Sn-based plating layer per side (metal Sn amount in the Sn-based plating layer). In short, a test piece of the Sn-based plated steel sheet, which is a measurement object, is prepared. A surface of the coating layer of the test piece is subjected to measurement of X-ray fluorescence intensity derived from metal Zr by using the X-ray fluorescence analysis apparatus (ZSX Primus, manufactured by Rigaku Corporation). The obtained X-ray fluorescence intensity and the calibration curve regarding metal Zr prepared in advance were used to calculate the content of the zirconium oxide (metal Zr amount) in the coating layer.

[Surface Color Tone (Yellowing) and Yellowing Over Time]

A surface color tone (yellowing) was determined by a b* value using SC-GV5, manufactured by Suga Test Instruments Co., Ltd., which is a commercially available colorimeter. Measurement conditions for b* were light source: C, total reflection, and measurement diameter: 30 mm. The yellowing over time was evaluated by performing a humidity cabinet test of placing a test material of the Sn-based plated steel sheet in a thermo-hygrostat kept at 40° C. and relative humidity of 80% for four weeks and finding a change amount Δb* of the color difference b* value before and after the humidity cabinet test.

When Δb* was 1 or less, the evaluation was "A", when it was more than 1 and 2 or less, the evaluation was "B", when it was more than 2 and 3 or less, the evaluation was "C", and when it was more than 3, the evaluation was "NG". The evaluations "A", "B", and "C" were regarded as being acceptable.

[Coating Film Adhesiveness]

The coating film adhesiveness was evaluated as follows.

The test material of the Sn-based plated steel sheet was subjected to the humidity cabinet test by the method described in [Yellowing resistance], and then 7 g/m$^2$ on a dry mass basis of a commercially available epoxy resin coating for can was applied to its surface, baked at 200° C. for 10 minutes, and placed at room temperature for 24 hours. Then, flaws reaching the steel sheet surface were formed in a grid form on the obtained Sn-based plated steel sheet (7 flaws in each of vertical and horizontal directions at an interval of 3 mm), and the portion was subjected to a tape peel test using a commercially available adhesive tape for evaluation.

When there was no peeling of the coating film at the tape stuck portion at all, the evaluation was "A", when there was peeling of the coating film around the flaws in the grid form, the evaluation was "B", and when there was peeling of the coating film in squares of the grid form, the evaluation was "NG". The evaluations "A" and "B" were regarded as being acceptable.

[Sulphide Stain Resistance]

The sulphide stain resistance was evaluated as follows.

After 7 g/m$^2$ on a dry mass basis of the commercially available epoxy resin coating for can was applied to the surface of the test material of the Sn-based plated steel sheet produced and subjected to the humidity cabinet test according to the method described in the above [Coating film adhesiveness], the test material was baked at 200° C. for 10 minutes and placed at room temperature for 24 hours. Then, the obtained Sn-based plated steel sheet was cut into a predetermined size and immersed in an aqueous solution composed of 0.3% of sodium dihydrogen phosphate, 0.7% of sodium hydrogenphosphate, and 0.6% of L-cysteine hydrochloride, subjected to a retort treatment at 121° C. for 60 minutes in a sealed container and evaluated from an external appearance after the test.

When there was no change in the external appearance at all before and after the test, the evaluation was "AA", when there was slight blackening (5% or less), the evaluation was "A", when there was blackening in a region of more than 5% and 10% or less, the evaluation was "B", and when there was blackening in a region of more than 10% of a test surface, the evaluation was "NG". The evaluations "AA", "A", and "B" were regarded as being acceptable.

[Post-Coating Corrosion Resistance]

The post-coating corrosion resistance was evaluated as follows.

After 7 g/m$^2$ on the dry mass basis of the commercially available epoxy resin coating for can was applied to the surface of the test material of the Sn-based plated steel sheet produced and subjected to the humidity cabinet test according to the method described in the above [Coating film adhesiveness], the test material was baked at 200° C. for 10 minutes and placed at room temperature for 24 hours. Then, the obtained Sn-based plated steel sheet was cut into a predetermined size and immersed in commercially available tomato juice at 60° C. for 7 days, and then the presence or absence of occurrence of rust was visually evaluated.

When there was no rust at all, the evaluation was "AA", when there was rust in an area ratio of 5% or less of the whole test surface, the evaluation was "A", when there was rust in an area ratio of more than 5% and 10% or less of the whole test surface, the evaluation was "B", and when there was rust in an area ratio of more than 10% of the whole test surface, the evaluation was "NG". The evaluations "AA", "A", and "B" were regarded as being acceptable.

Example 1

Table 1 lists cooling water immersion conditions before the formation of the zirconium oxide on the Sn-based plating layer and manufacturing conditions when forming conditions of the zirconium oxide are varied. The Sn-based plating was produced by an electrolytic method from a known ferrostan bath, and a quantity of electricity during electrolysis was varied so that the Sn coating weight per side was in a range of 0.2 g/m$^2$ to 30.0 g/m$^2$. Table 2 lists various properties of the obtained Sn-based plated steel sheets and results of property evaluations. Table 2 lists metal Sn equivalent contents of the Sn-based plating layer listed in Table 1 again. In all test pieces, zirconium contained in the coating was confirmed by XPS to be the zirconium oxide as specified in the present invention.

TABLE 1

| | | | | | | CATHODE ELECTROLYTIC TREATMENT | | | | | | | |
|---|---|---|---|---|---|---|---|---|---|---|---|---|---|
| | Sn PLATING | | COOLING WATER IMMERSION TREATMENT | | | CATHODE ELECTROLYTIC TREATMENT SOLUTION | | | FIRST ELECTROLYSIS | | SECOND ELECTROLYSIS | | |
| MANU- | CONTENT | HEATNG | COOLING WATER | | HEATING | ZIRCONIUM | SOLUTON | | CONDITION | | CONDITION | | |
| FACTURING METHOD No. | IN TERMS OF METAL Sn ($g/m^2$) | AND MELTING TREATMENT | HARD-NESS (ppm) | TEMPER-ATURE (° C) | AND MELTING TREATMENT | ION CONCENTRATION (ppm) | TEMPER-ATURE (° C) | pH | CURRENT DENSITY ($A/dm^2$) | TREATMENT TIME (sec) | CURRENT DENSITY ($A/dm^2$) | TREATMENT TIME (sec) | REMARKS |
| A1 | 2.8 | YES | 103 | 35 | 2.0 | 1400 | 35 | 3.7 | 2.0 | 0.8 | 0.5 | 0.8 | INVENTIVE EXAMPLE |
| A2 | 2.9 | YES | 108 | 35 | 2.0 | 1400 | 35 | 3.7 | 2.0 | 0.8 | 0.5 | 0.8 | INVENTIVE EXAMPLE |
| A3 | 2.8 | YES | 113 | 35 | 2.0 | 1400 | 35 | 3.7 | 2.0 | 0.8 | 0.5 | 0.8 | INVENTIVE EXAMPLE |
| A4 | 2.7 | YES | 142 | 35 | 2.0 | 1400 | 35 | 3.7 | 2.0 | 0.8 | 0.5 | 0.8 | INVENTIVE EXAMPLE |
| A5 | 2.8 | YES | 145 | 35 | 2.0 | 1400 | 35 | 3.7 | 2.0 | 0.8 | 0.5 | 0.8 | INVENTIVE EXAMPLE |
| A6 | 3.0 | YES | 156 | 35 | 2.0 | 1400 | 35 | 3.7 | 2.0 | 0.8 | 0.5 | 0.8 | INVENTIVE EXAMPLE |
| A7 | 2.8 | YES | 161 | 35 | 2.0 | 1400 | 35 | 3.7 | 2.0 | 0.8 | 0.5 | 0.8 | INVENTIVE EXAMPLE |
| AS | 2.9 | YES | 195 | 35 | 2.0 | 1400 | 35 | 3.7 | 2.0 | 0.8 | 0.6 | 0.8 | INVENTIVE EXAMPLE |
| A9 | 2.9 | YES | 195 | 35 | 2.0 | 1400 | 35 | 3.7 | 3.0 | 0.8 | 0.8 | 0.8 | INVENTIVE EXAMPLE |
| A10 | 2.8 | YES | 183 | 35 | 2.0 | 1400 | 35 | 3.7 | 2.0 | 0.8 | 0.5 | 0.8 | INVENTIVE EXAMPLE |
| A11 | 3.1 | YES | 212 | 35 | 2.0 | 1400 | 35 | 3.7 | 2.0 | 0.8 | 0.5 | 0.8 | INVENTIVE EXAMPLE |
| A12 | 3.1 | YES | 216 | 10 | 2.0 | 1400 | 35 | 3.7 | 2.0 | 0.8 | 0.5 | 0.8 | INVENTIVE EXAMPLE |
| A13 | 2.7 | YES | 219 | 50 | 2.0 | 1400 | 35 | 3.7 | 2.0 | 0.8 | 0.5 | 0.8 | INVENTIVE EXAMPLE |
| A14 | 2.8 | YES | 216 | 80 | 2.0 | 1400 | 35 | 3.7 | 2.0 | 0.8 | 0.5 | 0.8 | INVENTIVE EXAMPLE |
| A15 | 2.9 | YES | 220 | 35 | 0.5 | 1400 | 35 | 3.7 | 2.0 | 0.4 | 0.5 | 0.8 | INVENTIVE EXAMPLE |
| A16 | 2.9 | YES | 224 | 35 | 3.0 | 1400 | 35 | 3.7 | 2.0 | 1.2 | 0.5 | 0.8 | INVENTIVE EXAMPLE |
| A17 | 2.8 | YES | 219 | 35 | 5.0 | 1400 | 35 | 3.7 | 2.0 | 2.0 | 0.5 | 0.8 | INVENTIVE EXAMPLE |
| A18 | 3.1 | YES | 212 | 35 | 2.0 | 1000 | 35 | 3.7 | 2.0 | 0.8 | 0.4 | 0.8 | INVENTIVE EXAMPLE |
| A19 | 2.8 | YES | 221 | 35 | 2.0 | 2000 | 35 | 3.7 | 3.0 | 0.8 | 0.5 | 0.8 | INVENTIVE EXAMPLE |
| A20 | 2.7 | YES | 229 | 35 | 2.0 | 3000 | 35 | 3.7 | 5.0 | 0.8 | 0.6 | 0.8 | INVENTIVE EXAMPLE |

TABLE 1-continued

| | Sn PLATING | | COOLING WATER IMMERSION TREATMENT | | | CATHODE ELECTROLYTIC TREATMENT: CATHODE ELECTROLYTIC TREATMENT SOLUTION | | | CATHODE ELECTROLYTIC TREATMENT: FIRST ELECTROLYSIS CONDITION | | CATHODE ELECTROLYTIC TREATMENT: SECOND ELECTROLYSIS CONDITION | | |
|---|---|---|---|---|---|---|---|---|---|---|---|---|---|
| MANU- | CONTENT | HEATNG | COOLING WATER | | HEATING | ZIRCONIUM | SOLUTON | | | | | | |
| FACTURING METHOD No. | IN TERMS OF METAL Sn ($g/m^2$) | AND MELTING TREATMENT | HARD-NESS (ppm) | TEMPER-ATURE (° C) | AND MELTING TREATMENT | ION CONCENTRATION (ppm) | TEMPER-ATURE (° C) | pH | CURRENT DENSITY ($A/dm^2$) | TREATMENT TIME (sec) | CURRENT DENSITY ($A/dm^2$) | TREATMENT TIME (sec) | REMARKS |
| A21 | 2.8 | YES | 233 | 35 | 2.0 | 4000 | 35 | 3.7 | 7.0 | 0.6 | 0.8 | 0.8 | INVENTIVE EXAMPLE |
| A22 | 2.7 | YES | 221 | 35 | 2.0 | 1400 | 5 | 3.7 | 2.0 | 0.8 | 0.5 | 0.8 | INVENTIVE EXAMPLE |
| A23 | 2.9 | YES | 226 | 35 | 2.0 | 1400 | 15 | 3.7 | 2.0 | 0.8 | 0.5 | 0.8 | INVENTIVE EXAMPLE |
| A24 | 2.8 | YES | 225 | 35 | 2.0 | 1400 | 40 | 3.7 | 3.0 | 0.8 | 0.5 | 0.8 | INVENTIVE EXAMPLE |
| A25 | 2.8 | YES | 220 | 35 | 2.0 | 1400 | 50 | 3.7 | 5.0 | 0.8 | 0.5 | 0.8 | INVENTIVE EXAMPLE |
| A26 | 2.9 | YES | 220 | 35 | 2.0 | 1400 | 35 | 3.5 | 2.0 | 0.8 | 0.5 | 0.8 | INVENTIVE EXAMPLE |
| A27 | 2.9 | YES | 216 | 35 | 2.0 | 1400 | 35 | 4.3 | 6.0 | 0.8 | 0.5 | 0.8 | INVENTIVE EXAMPLE |
| A28 | 2.8 | YES | 219 | 35 | 2.0 | 1400 | 35 | 3.7 | 2.0 | 0.8 | 0.3 | 0.8 | INVENTIVE EXAMPLE |
| A29 | 2.8 | YES | 216 | 35 | 2.0 | 1400 | 35 | 3.8 | 4.0 | 0.8 | 0.5 | 0.8 | INVENTIVE EXAMPLE |
| A30 | 2.8 | YES | 214 | 35 | 2.0 | 1400 | 35 | 3.9 | 7.0 | 0.6 | 0.5 | 0.8 | INVENTIVE EXAMPLE |
| A31 | 2.8 | YES | 213 | 35 | 2.0 | 1400 | 35 | 3.7 | 10.0 | 0.8 | 0.5 | 0.8 | INVENTIVE EXAMPLE |
| A32 | 2.9 | YES | 290 | 35 | 2.0 | 1400 | 35 | 3.7 | 2.0 | 0.8 | 0.5 | 0.8 | INVENTIVE EXAMPLE |
| A33 | 2.9 | YES | 294 | 35 | 2.0 | 1400 | 35 | 3.7 | 2.0 | 0.8 | 0.5 | 0.8 | INVENTIVE EXAMPLE |
| A34 | 2.8 | NO | 298 | 35 | 2.0 | 1400 | 35 | 3.7 | 2.0 | 0.8 | 0.5 | 0.8 | INVENTIVE EXAMPLE |
| A35 | 1.2 | YES | 201 | 35 | 2.0 | 1400 | 35 | 3.7 | 2.0 | 0.8 | 0.5 | 0.8 | INVENTIVE EXAMPLE |
| A36 | 14.8 | YES | 213 | 35 | 2.0 | 1400 | 35 | 3.7 | 2.0 | 0.8 | 0.5 | 0.8 | INVENTIVE EXAMPLE |
| A37 | 1.9 | YES | 203 | 35 | 2.0 | 1400 | 35 | 3.7 | 2.0 | 0.8 | 0.5 | 0.8 | INVENTIVE EXAMPLE |
| A38 | 2.1 | YES | 203 | 35 | 2.0 | 1400 | 35 | 3.7 | 2.0 | 0.8 | 0.5 | 0.8 | INVENTIVE EXAMPLE |
| A39 | 4.8 | YES | 202 | 35 | 2.0 | 1400 | 35 | 3.7 | 2.0 | 0.8 | 0.5 | 0.8 | INVENTIVE EXAMPLE |
| A40 | 5.2 | YES | 203 | 35 | 2.0 | 1400 | 35 | 3.7 | 2.0 | 0.8 | 0.5 | 0.8 | INVENTIVE EXAMPLE |
| A41 | 8.0 | YES | 201 | 35 | 2.0 | 1400 | 35 | 3.7 | 2.0 | 0.8 | 0.5 | 0.8 | INVENTIVE EXAMPLE |

TABLE 1-continued

| | Sn PLATING | | COOLING WATER IMMERSION TREATMENT | | | CATHODE ELECTROLYTIC TREATMENT: CATHODE ELECTROLYTIC TREATMENT SOLUTION | | | CATHODE ELECTROLYTIC TREATMENT: FIRST ELECTROLYSIS CONDITION | | CATHODE ELECTROLYTIC TREATMENT: SECOND ELECTROLYSIS CONDITION | | |
|---|---|---|---|---|---|---|---|---|---|---|---|---|---|
| MANU- | CONTENT | HEATNG | COOLING WATER | | HEATING | ZIRCONIUM | SOLUTON | | | | | | |
| FACTURING METHOD No. | IN TERMS OF METAL Sn ($g/m^2$) | AND MELTING TREATMENT | HARD-NESS (ppm) | TEMPER-ATURE (° C) | AND MELTING TREATMENT | ION CONCENTRATION (ppm) | TEMPER-ATURE (° C) | pH | CURRENT DENSITY ($A/dm^2$) | TREATMENT TIME (sec) | CURRENT DENSITY ($A/dm^2$) | TREATMENT TIME (sec) | REMARKS |
| A42 | 10.2 | YES | 205 | 35 | 2.0 | 1400 | 35 | 3.7 | 2.0 | 0.8 | 0.5 | 0.8 | INVENTIVE EXAMPLE |
| A43 | 13.1 | YES | 203 | 35 | 2.0 | 1400 | 35 | 3.7 | 2.0 | 0.8 | 0.5 | 0.8 | INVENTIVE EXAMPLE |
| B1 | 2.9 | YES | 79 | 35 | 2.0 | 1400 | 35 | 3.7 | 2.0 | 0.8 | 0.8 | 0.8 | COMPARATIVE EXAMPLE |
| B2 | 2.8 | YES | 91 | 35 | 2.0 | 1400 | 35 | 3.7 | 2.0 | 0.8 | 0.8 | 0.8 | COMPARATIVE EXAMPLE |
| B3 | 2.7 | YES | 96 | 35 | 2.0 | 1400 | 35 | 3.7 | 2.0 | 0.8 | 0.8 | 0.8 | COMPARATIVE EXAMPLE |
| B4 | 2.8 | YES | 304 | 35 | 2.0 | 1400 | 35 | 3.7 | 2.0 | 0.8 | 0.8 | 0.8 | COMPARATIVE EXAMPLE |
| B5 | 2.8 | YES | 317 | 35 | 2.0 | 1400 | 35 | 3.7 | 2.0 | 0.8 | 0.8 | 0.8 | COMPARATIVE EXAMPLE |
| B6 | 2.9 | YES | 337 | 35 | 2.0 | 1400 | 35 | 3.7 | 2.0 | 0.8 | 0.8 | 0.8 | COMPARATIVE EXAMPLE |
| B7 | 0.8 | YES | 240 | 35 | 2.0 | 1400 | 35 | 3.7 | 2.0 | 0.8 | 0.8 | 0.8 | COMPARATIVE EXAMPLE |
| B8 | 30.0 | YES | 246 | 35 | 2.0 | 1400 | 35 | 3.7 | 2.0 | 0.8 | 0.8 | 0.8 | COMPARATIVE EXAMPLE |
| B9 | 15.2 | YES | 212 | 35 | 2.0 | 1400 | 35 | 3.7 | 2.0 | 0.8 | 0.5 | 0.8 | COMPARATIVE EXAMPLE |
| B10 | 2.8 | YES | 242 | 5 | 2.0 | 1400 | 35 | 3.7 | 0.5 | 0.8 | 0.8 | 0.8 | COMPARATIVE EXAMPLE |
| B11 | 2.7 | YES | 246 | 5 | 2.0 | 1400 | 35 | 3.7 | 11.0 | 0.8 | 0.8 | 0.8 | COMPARATIVE EXAMPLE |
| B12 | 2.8 | YES | 246 | 5 | 2.0 | 1400 | 35 | 3.7 | 12.0 | 0.8 | 0.8 | 0.8 | COMPARATIVE EXAMPLE |
| B13 | 2.8 | YES | 246 | 95 | 2.0 | 1400 | 35 | 3.7 | 13.0 | 0.8 | 0.8 | 0.8 | COMPARATIVE EXAMPLE |
| B14 | 2.8 | YES | 242 | 35 | 2.0 | 1400 | 35 | 3.7 | 2.0 | 0.8 | — | — | COMPARATIVE EXAMPLE |
| B15 | 2.8 | YES | 246 | 35 | 2.0 | 1400 | 35 | 3.7 | 10.0 | 0.8 | — | — | COMPARATIVE EXAMPLE |
| B16 | 2.8 | YES | 242 | 35 | 2.0 | 1400 | 35 | 3.7 | 3.0 | 0.8 | 1.2 | 0.8 | COMPARATIVE EXAMPLE |
| B17 | 0.8 | YES | 242 | 35 | 2.0 | 1400 | 35 | 3.7 | 2.0 | 0.8 | 0.5 | 0.8 | COMPARATIVE EXAMPLE |

TABLE 2

| No. | MANU-FACT-URING METHOD No. | Sn PLATING CONTENT IN TERMS OF METAL Sn (g/m$^2$) | COATING LAYER ZIRCONIUM OXIDE CONTENT IN TERMS OF METAL Zr (mg/m$^2$) | LOWER LAYER | UPPER LAYER | NUMBER OF DETECTED LOCATIONS OF CRYSTAL-LLINE LAYER IN UPPER LAYER | AMORPPHOUS STRUCTURE RATIO (%) | PROPERTY EVALUATION SURFACE COLOR TONE INITIAL b* | b* AFTER HUMDITY CABINET TEST | Δb* BEFORE AND AFTER HUMDITY CABINET TEST | | COATING FILM ADHESIVE-NESS | SULFUR-IZATION BLACKENING RESISTANCE | POST-COATING CORROSION RESISTANCE | REMARKS |
|---|---|---|---|---|---|---|---|---|---|---|---|---|---|---|---|
| a1 | A1 | 2.8 | 4.0 | AMOR-PHOUS | CRYSTAL-LINE | 7 | 30 | 2.7 | 3.8 | 1.1 | B | A | B | B | INVENTIVE EXAMPLE |
| a2 | A2 | 2.9 | 4.0 | AMOR-PHOUS | CRYSTAL-LINE | 6 | 40 | 2.8 | 4.1 | 1.3 | B | A | B | B | INVENTIVE EXAMPLE |
| a3 | A3 | 2.8 | 4.0 | AMOR-PHOUS | CRYSTAL-LINE | 6 | 40 | 2.8 | 3.9 | 1.1 | B | A | B | B | INVENTIVE EXAMPLE |
| a4 | A4 | 2.7 | 4.0 | AMOR-PHOUS | CRYSTAL-LINE | 6 | 40 | 2.9 | 3.9 | 1.0 | B | A | B | B | INVENTIVE EXAMPLE |
| as | A5 | 2.8 | 4.0 | AMOR-PHOUS | CRYSTAL-LINE | 5 | 50 | 2.8 | 3.7 | 0.9 | A | A | B | B | INVENTIVE EXAMPLE |
| a6 | A6 | 3.0 | 4.0 | AMOR-PHOUS | CRYSTAL-LINE | 2 | 80 | 2.7 | 3.6 | 0.9 | A | A | A | A | INVENTIVE EXAMPLE |
| a7 | A7 | 2.8 | 4.0 | AMOR-PHOUS | CRYSTAL-LINE | 1 | 90 | 2.8 | 3.5 | 0.7 | A | A | A | A | INVENTIVE EXAMPLE |
| a8 | A8 | 2.9 | 5.0 | AMOR-PHOUS | CRYSTAL-LINE | 1 | 90 | 2.6 | 3.1 | 0.5 | A | A | A | A | INVENTIVE EXAMPLE |
| a9 | A9 | 2.9 | 8.0 | AMOR-PHOUS | CRYSTAL-LINE | 4 | 60 | 3.0 | 3.3 | 0.3 | A | B | AA | A | INVENTIVE EXAMPLE |
| a10 | A10 | 2.8 | 4.0 | AMOR-PHOUS | CRYSTAL-LINE | 1 | 90 | 2.7 | 3.6 | 0.9 | A | A | A | A | INVENTIVE EXAMPLE |
| a11 | A11 | 3.1 | 4.0 | AMOR-PHOUS | CRYSTAL-LINE | 1 | 90 | 2.9 | 3.1 | 0.2 | A | A | A | A | INVENTIVE EXAMPLE |
| a12 | A12 | 3.1 | 4.0 | AMOR-PHOUS | CRYSTAL-LINE | 1 | 90 | 2.8 | 3.3 | 0.5 | A | A | A | A | INVENTIVE EXAMPLE |
| a13 | A13 | 2.7 | 4.0 | AMOR-PHOUS | CRYSTAL-LINE | 1 | 90 | 2.8 | 3.5 | 0.7 | A | A | A | A | INVENTIVE EXAMPLE |
| a14 | A14 | 2.8 | 4.0 | AMOR-PHOUS | CRYSTAL-LINE | 1 | 90 | 2.6 | 3.5 | 0.9 | A | A | A | A | INVENTIVE EXAMPLE |
| a15 | A15 | 2.9 | 3.0 | AMOR-PHOUS | CRYSTAL-LINE | 1 | 90 | 2.9 | 3.5 | 0.6 | A | A | A | A | INVENTIVE EXAMPLE |
| a16 | A16 | 2.9 | 6.0 | AMOR-PHOUS | CRYSTAL-LINE | 1 | 90 | 2.9 | 3.3 | 0.4 | A | A | AA | A | INVENTIVE EXAMPLE |
| a17 | A17 | 2.8 | 7.0 | AMOR-PHOUS | CRYSTAL-LINE | 1 | 90 | 2.8 | 3.6 | 0.8 | A | A | AA | A | INVENTIVE EXAMPLE |
| a18 | A18 | 3.1 | 2.0 | AMOR-PHOUS | CRYSTAL-LINE | 3 | 70 | 2.4 | 3.2 | 0.8 | A | A | B | B | INVENTIVE EXAMPLE |
| a19 | A19 | 2.8 | 6.0 | AMOR-PHOUS | CRYSTAL-LINE | 1 | 90 | 2.6 | 3.4 | 0.8 | A | A | AA | A | INVENTIVE EXAMPLE |
| a20 | A20 | 2.7 | 8.0 | AMOR-PHOUS | CRYSTAL-LINE | 1 | 90 | 2.9 | 3.1 | 0.2 | A | A | AA | A | INVENTIVE EXAMPLE |

TABLE 2-continued

| | | Sn PLATING | COATING LAYER ZIRCONIUM OXIDE | | | | | PROPERTY EVALUATION SURFACE COLOR TONE | | | | | | | |
|---|---|---|---|---|---|---|---|---|---|---|---|---|---|---|---|
| No. | MANU-FACT-URING METHOD No. | CONTENT IN TERMS OF METAL Sn ($g/m^2$) | CONTENT IN TERMS OF METAL Zr ($mg/m^2$) | LOWER LAYER | UPPER LAYER | NUMBER OF DETECTED LOCATIONS OF CRYSTAL-LLINE LAYER IN UPPER LAYER | AMORPPHOUS STRUCTURE RATIO (%) | INITIAL b* | b* AFTER HUMDITY CABINET TEST | Δb* BEFORE AND AFTER HUMDITY CABINET TEST | | COATING FILM ADHESIVE-NESS | SULFUR-IZATION BLACKENING RESISTANCE | POST-COATING CORROSION RESISTANCE | REMARKS |
| a21 | A21 | 2.8 | 10.0 | AMOR-PHOUS | CRYSTAL-LINE | 4 | 60 | 3.1 | 3.4 | 0.3 | A | B | AA | A | INVENTIVE EXAMPLE |
| a22 | A22 | 2.7 | 1.0 | AMOR-PHOUS | CRYSTAL-LINE | 5 | 50 | 2.2 | 3.1 | 0.9 | A | A | B | B | INVENTIVE EXAMPLE |
| a23 | A23 | 2.9 | 2.0 | AMOR-PHOUS | CRYSTAL-LINE | 1 | 90 | 2.3 | 3.1 | 0.8 | A | A | A | A | INVENTIVE EXAMPLE |
| a24 | A24 | 2.8 | 5.0 | AMOR-PHOUS | CRYSTAL-LINE | 1 | 90 | 2.5 | 3.4 | 0.9 | A | A | A | A | INVENTIVE EXAMPLE |
| a25 | A25 | 2.8 | 7.0 | AMOR-PHOUS | CRYSTAL-LINE | 1 | 90 | 2.7 | 3.2 | 0.5 | A | A | AA | A | INVENTIVE EXAMPLE |
| a26 | A26 | 2.9 | 2.0 | AMOR-PHOUS | CRYSTAL-LINE | 1 | 90 | 2.2 | 2.9 | 0.7 | A | A | A | A | INVENTIVE EXAMPLE |
| a27 | A27 | 2.9 | 8.0 | AMOR-PHOUS | CRYSTAL-LINE | 1 | 90 | 2.9 | 3.5 | 0.6 | A | A | AA | A | INVENTIVE EXAMPLE |
| a28 | A28 | 2.8 | 2.0 | AMOR-PHOUS | CRYSTAL-LINE | 1 | 90 | 2.3 | 2.9 | 0.6 | A | A | A | A | INVENTIVE EXAMPLE |
| a29 | A29 | 2.8 | 3.0 | AMOR-PHOUS | CRYSTAL-LINE | 3 | 70 | 2.7 | 3.5 | 0.8 | A | A | A | A | INVENTIVE EXAMPLE |
| a30 | A30 | 2.8 | 5.0 | AMOR-PHOUS | CRYSTAL-LINE | 3 | 70 | 2.7 | 3.3 | 0.6 | A | A | A | A | INVENTIVE EXAMPLE |
| a31 | A31 | 2.8 | 8.0 | AMOR-PHOUS | CRYSTAL-LINE | 3 | 70 | 2.5 | 2.9 | 0.4 | A | A | AA | A | INVENTIVE EXAMPLE |
| a32 | A32 | 2.9 | 4.0 | AMOR-PHOUS | CRYSTAL-LINE | 6 | 40 | 2.4 | 3.1 | 0.7 | B | A | B | B | INVENTIVE EXAMPLE |
| a33 | A33 | 2.9 | 5.0 | AMOR-PHOUS | CRYSTAL-LINE | 7 | 30 | 2.5 | 3.1 | 0.6 | B | A | B | B | INVENTIVE EXAMPLE |
| a34 | A34 | 2.8 | 4.0 | AMOR-PHOUS | CRYSTAL-LINE | 7 | 30 | 2.5 | 3.2 | 0.7 | B | A | B | B | INVENTIVE EXAMPLE |
| a35 | A35 | 1.2 | 5.0 | AMOR-PHOUS | CRYSTAL-LINE | 5 | 50 | 1.7 | 1.8 | 0.1 | A | A | B | B | INVENTIVE EXAMPLE |
| a36 | A36 | 14.8 | 4.0 | AMOR-PHOUS | CRYSTAL-LINE | 5 | 50 | 4.5 | 7.2 | 2.7 | C | B | B | A | INVENTIVE EXAMPLE |
| a37 | A37 | 1.9 | 5.0 | AMOR-PHOUS | CRYSTAL-LINE | 5 | 50 | 1.9 | 2.2 | 0.3 | A | A | B | B | INVENTIVE EXAMPLE |
| a38 | A38 | 2.1 | 5.0 | AMOR-PHOUS | CRYSTAL-LINE | 5 | 50 | 1.9 | 2.3 | 0.4 | A | A | B | A | INVENTIVE EXAMPLE |
| a39 | A39 | 4.8 | 5.0 | AMOR-PHOUS | CRYSTAL-LINE | 5 | 50 | 2.8 | 3.6 | 0.8 | A | A | B | A | INVENTIVE EXAMPLE |
| a40 | A40 | 5.2 | 5.0 | AMOR-PHOUS | CRYSTAL-LINE | 5 | 50 | 2.8 | 3.7 | 0.9 | A | A | B | AA | INVENTIVE EXAMPLE |
| a41 | A41 | 8.0 | 5.0 | AMOR-PHOUS | CRYSTAL-LINE | 5 | 50 | 3.2 | 4.0 | 0.8 | A | A | B | AA | INVENTIVE EXAMPLE |

TABLE 2-continued

| | | Sn PLATING | COATING LAYER ZIRCONIUM OXIDE | | | | | PROPERTY EVALUATION SURFACE COLOR TONE | | | | | | | |
|---|---|---|---|---|---|---|---|---|---|---|---|---|---|---|---|
| No. | MANU-FACT-URING METHOD No. | CONTENT IN TERMS OF METAL Sn ($g/m^2$) | CONTENT IN TERMS OF METAL Zr ($mg/m^2$) | LOWER LAYER | UPPER LAYER | NUMBER OF DETECTED LOCATIONS OF CRYSTAL-LLINE LAYER IN UPPER LAYER | AMORPPHOUS STRUCTURE RATIO (%) | INITIAL b* | b* AFTER HUMDITY CABINET TEST | Δb* BEFORE AND AFTER HUMDITY CABINET TEST | | COATING FILM ADHESIVE-NESS | SULFUR-IZATION BLACKENING RESISTANCE | POST-COATING CORROSION RESISTANCE | REMARKS |
| a42 | A42 | 102 | 5.0 | AMOR-PHOUS | CRYSTAL-LINE | 5 | 50 | 3.5 | 4.3 | 0.8 | A | A | B | AA | INVENTIVE EXAMPLE |
| a43 | A43 | 13.1 | 5.0 | AMOR-PHOUS | CRYSTAL-LINE | 5 | 50 | 4.2 | 5.1 | 0.9 | A | A | B | AA | INVENTIVE EXAMPLE |
| b1 | B1 | 2.9 | 4.0 | CRYSTAL-LINE | CRYSTAL-LINE | 10 | 0 | 3.1 | 5.4 | 2.3 | C | B | NG | NG | COMPARATIVE EXAMPLE |
| b2 | B2 | 2.8 | 4.0 | CRYSTAL-LINE | CRYSTAL-LINE | 10 | 0 | 3.2 | 5.3 | 2.1 | C | B | NG | NG | COMPARATIVE EXAMPLE |
| b3 | B3 | 2.7 | 4.0 | CRYSTAL-LINE | CRYSTAL-LINE | 10 | 0 | 3.3 | 5.1 | 1.8 | C | B | NG | NG | COMPARATIVE EXAMPLE |
| b4 | B4 | 2.8 | 4.0 | CRYSTAL-LINE | CRYSTAL-LINE | 10 | 0 | 3.1 | 5.3 | 2.2 | C | B | NG | NG | COMPARATIVE EXAMPLE |
| b5 | B5 | 2.8 | 4.0 | CRYSTAL-LINE | CRYSTAL-LINE | 10 | 0 | 3.3 | 5.5 | 2.2 | C | B | NG | NG | COMPARATIVE EXAMPLE |
| b6 | B6 | 2.9 | 4.0 | CRYSTAL-LINE | CRYSTAL-LINE | 10 | 0 | 3.4 | 7.6 | 4.2 | C | B | NG | NG | COMPARATIVE EXAMPLE |
| b7 | B7 | 0.8 | 4.0 | AMOR-PHOUS | CRYSTAL-LINE | 3 | 70 | 2.3 | 2.6 | 0.3 | B | A | A | NG | COMPARATIVE EXAMPLE |
| b8 | B8 | 30.0 | 4.0 | AMOR-PHOUS | CRYSTAL-LINE | 3 | 70 | 4.3 | 7.4 | 3.1 | C | NG | B | A | COMPARATIVE EXAMPLE |
| b9 | B9 | 152 | 4.0 | AMOR-PHOUS | CRYSTAL-LINE | 5 | 50 | 4.5 | 7.2 | 2.7 | C | B | NG | AA | COMPARATIVE EXAMPLE |
| b10 | B10 | 2.8 | 0.3 | CRYSTAL-LINE | CRYSTAL-LINE | 10 | 0 | 2.2 | 4.6 | 2.4 | C | B | NG | NG | COMPARATIVE EXAMPLE |
| b11 | B11 | 2.7 | 11.0 | CRYSTAL-LINE | CRYSTAL-LINE | 10 | 0 | 4.2 | 6.5 | 2.3 | C | NG | NG | NG | COMPARATIVE EXAMPLE |
| b12 | B12 | 2.8 | 12.0 | CRYSTAL-LINE | CRYSTAL-LINE | 10 | 0 | 4.5 | 6.7 | 2.2 | C | NG | NG | NG | COMPARATIVE EXAMPLE |
| b13 | B13 | 2.8 | 14.0 | CRYSTAL-LINE | CRYSTAL-LINE | 10 | 0 | 4.8 | 6.9 | 2.1 | C | NG | NG | NG | COMPARATIVE EXAMPLE |
| b14 | B14 | 2.8 | 0.3 | AMOR-PHOUS | AMOR-PHOUS | 0 | 100 | 2.2 | 4.6 | 2.4 | B | NG | A | A | COMPARATIVE EXAMPLE |
| b15 | B15 | 2.8 | 14.0 | AMOR-PHOUS | AMOR-PHOUS | 0 | 100 | 5.1 | 5.9 | 0.8 | A | NG | AA | A | COMPARATIVE EXAMPLE |
| b16 | B16 | 2.8 | 6.0 | AMOR-PHOUS | AMOR-PHOUS | 0 | 100 | 3.4 | 4.3 | 0.9 | A | NG | AA | A | COMPARATIVE EXAMPLE |
| b17 | B17 | 0.8 | 5.0 | AMOR-PHOUS | CRYSTAL-LINE | 5 | 50 | 1.7 | 1.8 | 0.1 | A | A | A | NG | COMPARATIVE EXAMPLE |

It was found from Table 2 that a1 to a43, which were in the range of the present invention, were excellent in all performances. On the other hand, b1 to b17, which were comparative examples, were inferior in at least any of the yellowing resistance, the coating film adhesiveness, the sulphide stain resistance, or the post-coating corrosion resistance.

Preferred embodiments of the present invention have been described above in detail, but the present invention is not limited to the embodiments. It should be understood that various changes and modifications are readily apparent to those skilled in the art who has the common general knowledge in the technical field to which the present invention pertains, within the scope of the technical spirit as set forth in claims, and they should also be covered by the technical scope of the present invention.

What is claimed is:

1. A Sn-based plated steel sheet comprising:

a steel sheet;

a Sn-based plating layer located on at least one surface of the steel sheet; and a coating layer located on the Sn-based plating layer, wherein the Sn-based plating layer contains 1.0 $g/m^2$ to 15.0 $g/m^2$ of Sn per side in terms of metal Sn, the coating layer contains zirconium oxide, and a content of the zirconium oxide is 1.0 $mg/m^2$ to 10.0 $mg/m^2$ per side in terms of metal Zr, the zirconium oxide includes zirconium oxide with an amorphous structure, and a crystalline layer whose main component is zirconium oxide with a crystalline structure is present on an upper layer of the zirconium oxide with the amorphous structure, wherein the crystalline structure is determined when a clear diffraction spot is obtained in an electron beam diffraction pattern, and the amorphous structure is determined when a continuous ring-shaped diffraction pattern is obtained instead of the clear diffraction spot.

2. The Sn-based plated steel sheet according to claim 1, wherein the crystalline layer in the coating layer includes an uppermost surface portion of the coating layer, and the number of detected locations of the crystalline layer is at least one or more in order from the uppermost surface portion in a thickness direction, wherein the uppermost surface portion means a portion including an uppermost surface of the coating layer among each of 10 equal portions of the coating layer in the thickness direction at any position of the coating layer, and the number of detected locations of the crystalline layer means the number of locations determined to be the crystalline structure among 10 measured locations in the electron beam diffraction pattern at a center portion of the thickness direction of each portion among 10 equal portions where the coating layer is divided into 10 equal portions in the thickness direction at any position of the coating layer.

3. The Sn-based plated steel sheet according to claim 2, wherein the number of detected locations of the crystalline layer is five or less, including the uppermost surface portion of the coating layer and in order from the uppermost surface portion in the thickness direction.

* * * * *